US007413379B2

(12) United States Patent
Creel et al.

(10) Patent No.: US 7,413,379 B2
(45) Date of Patent: Aug. 19, 2008

(54) BOAT STORAGE STAND

(76) Inventors: Tommy C. Creel, 1925 SW. Americana St., Port St. Lucie, FL (US) 34953; Sabrina N. Creel, 1925 SW. Americana St., Port St. Lucie, FL (US) 34953

( * ) Notice: Subject to any disclaimer, the term of this patent is extended or adjusted under 35 U.S.C. 154(b) by 87 days.

(21) Appl. No.: 11/457,475

(22) Filed: Jul. 14, 2006

(65) Prior Publication Data

US 2008/0011916 A1 Jan. 17, 2008

(51) Int. Cl.
*B63C 1/08* (2006.01)
*B63C 1/10* (2006.01)

(52) U.S. Cl. ..... 405/7; 114/55; 248/346.01; 248/671

(58) Field of Classification Search ..... 405/7, 405/3, 4; 114/44, 45, 51; 248/346.01, 346.03, 248/349.1, 370, 125.9, 671
See application file for complete search history.

(56) References Cited

U.S. PATENT DOCUMENTS

| | | | | |
|---|---|---|---|---|
| 3,430,911 | A * | 3/1969 | Olson | 254/100 |
| 3,579,996 | A * | 5/1971 | Edson | 405/1 |
| 5,186,576 | A * | 2/1993 | Fournier | 405/7 |
| 5,622,447 | A * | 4/1997 | Fournier | 405/7 |
| 6,923,138 | B2 * | 8/2005 | Holbrook | 114/344 |
| 7,025,531 | B1 * | 4/2006 | Fournier | 405/7 |
| 2005/0285370 | A1 * | 12/2005 | Ebbenga | 280/414.1 |

* cited by examiner

*Primary Examiner*—Amy J. Sterling
(74) *Attorney, Agent, or Firm*—Woodard, Emhardt, Moriarty, McNett & Henry LLP

(57) ABSTRACT

A boat support stands. A pair of aligned and mutually opposed beds is pivotally mounted by risers atop a base plate. A cable and spring urge the beds to move together.

6 Claims, 4 Drawing Sheets

BOAT STORAGE STAND

BACKGROUND OF THE INVENTION

1. Field of the Invention

The present invention relates generally to the field of supports and more specifically, supports for holding and storing a boat.

2. Description of the Prior Art

A variety of lifts and supports exist for holding and storing a boat. For example, a typical lift includes a pair of longitudinally extending members upon which the boat nay be floated onto with the members then being liftable to position the boat above the water. For long term storage, boats may be lifted with a crane or other device and then set upon a permanently positioned storage stand. Some stands have immovable members to receive the hull of the boat; however, such stands are less desirable since the configuration or shape of each boat hull is different between boat manufacturers. Thus, the elongated members that support the boat upon the stand are movably mounted to conform and nestingly receive and hold the boat.

An example of a boat support stand is shown in the U.S. Pat. No. 5,622,447 that has a pair of mutually opposed and pivotally mounted beds. When the boat is set upon one of the beds, the remaining bed will be forced downwardly through a cam and slot combination that connects the inner opposed ends of the two aligned beds thereby conforming the bed to the shape of the boat hull. Large springs return each bed to the horizontal position when the boat is removed thereby horizontally aligning the beds to receive the next boat placed on the stand.

Marinas and other boat storage facilities require a large number of boat storage stands since a separate stand must be used and reserved for each boat As a result, it is desirable to provide a relatively low cost but well constructed boat stand that does not require maintenance such as might be required from inner-connecting and sliding components. Disclosed herein is such a boat storage stand. Our boat store stand includes a single mechanism that not only forces one bed to the downward position when the remaining bed is forced downwardly by the boat hull but also urges both beds to the horizontal position once the boat is removed therefrom.

SUMMARY OF THE INVENTION

One embodiment of the present invention is a storage stand for holding a boat and including a base. An upwardly extending riser means is mounted to the base first and: second beds are mounted to the riser means while being movable from an upper position to receive a boat and a downward position engaging and supporting the boat placed thereon. The beds have inner and outer ends and are pivotally mounted to the riser means between the inner ends and the outer ends. A line extends from the fast bed to the second bed and is operable to move the second bed to the downward position in response to die first bed moving to the downward position nestingly holding a boat thereatop.

It is an object of the present invention to provide a new and improved boat storage stand.

A further object of the present invention is to provide a boat storage stand that minimizes maintenance of the stand, A further object of the present invention is to provide a support stand that is relatively low cost to produce.

Related objects and advantages of the present invention will be apparent from the following description.

DESCRIPTION OF THE PREFERRED EMBODIMENT

Figure 1:
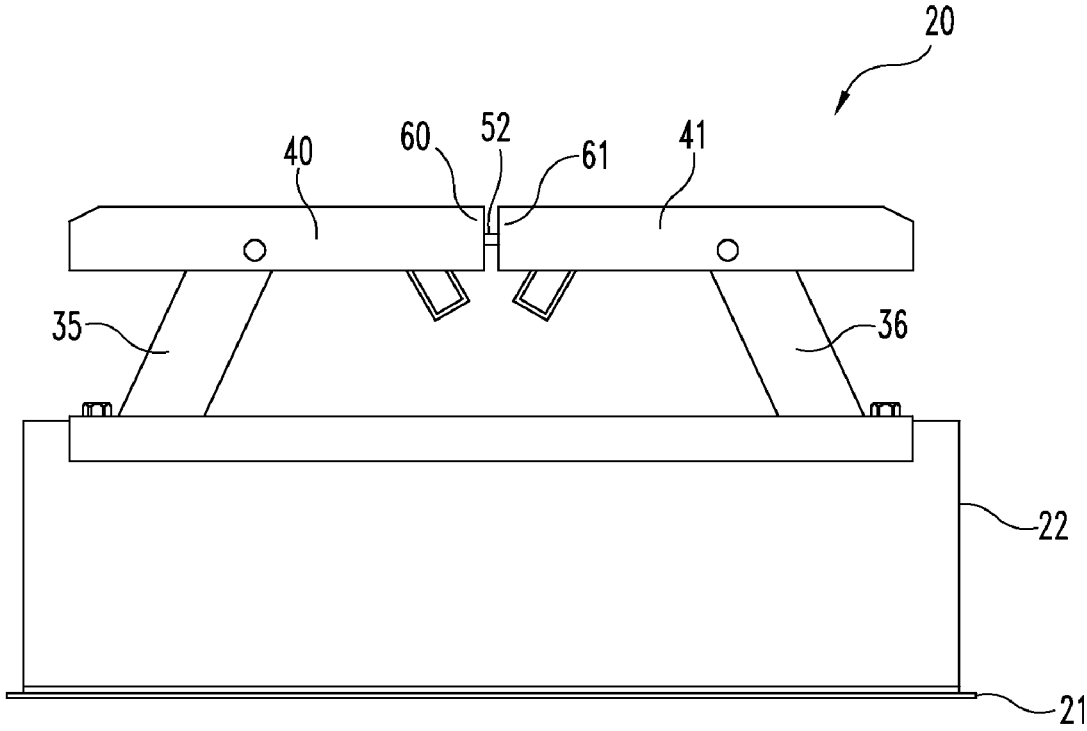
FIG. 1 is a side view of the boat support stand incorporating our present invention pith the beds shown in the horizontal position.

For the purposes of promoting an understanding of the principles of the invention, reference will now be made to the embodiment illustrated in the drawings and specific language will be used to describe the sane. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
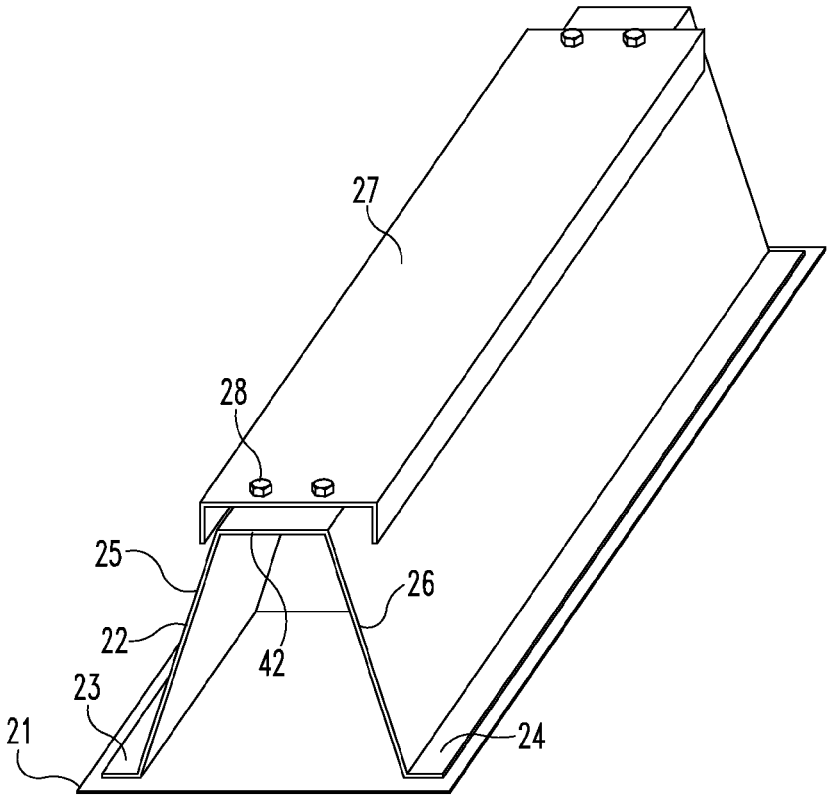
FIG. 3 is a perspective view of the bottom portion of the stand shown in FIG. 2 with the riser base plate mounted thereon.

Referring now more particularly to FIG. 1, there is shown a boat support stand 20 having a flat base plate 21 upon which is mounted an inverted unshaped base plate seat 22. Seat 22 (FIG. 3) has a pair of outwardly tried bottom flanges 23 and 24 that may be affixed to base plate 21. In the preferred embodiment, flanges 23 and 24 are welded to base 21. Seat 22 includes a pair of converging walls 5 and 26 that extend upwardly from flanges 23 and 24 to a horizontally extending center wall 42. An inverted c-shaped channel 27 forming a riser tube base plate is mounted atop wall 42. In the preferred embodiment, a conventional fastening bolt 28 extends through channel 27 and center wall 42 thereby securing the channel to the base plate seat 22. In order to maximize the stability of the boat stand, base plate 21 has a greater length than the length of base plate seat 22 which has a length longer than the c-shaped channel 27.

Figure 2:
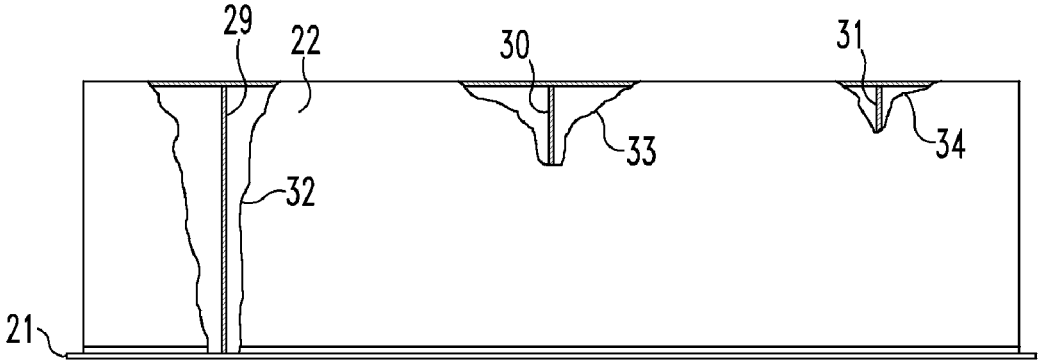
FIG. 2 is a fragmentary side view of the bottom portion of the stand of FIG. 1.

A plurality of base plate seat braces 29, 30 and 31 (FIG. 2) are fixedly mounted atop base plate 21 and to the interior surface of side walls 25 and 26 of the base plate seat 22. Thus, braces 29-31 are trapezoidal in shape. Base plate seat 22 is fragmented in areas 32-34 in FIG. 2 to illustrate the positioning of braces 29-31. Braces 29 and 31 are positioned towards the outer ends of seat 22 whereas brace 30 is positioned equi-distant between the ends of seat 22.

Figure 4:
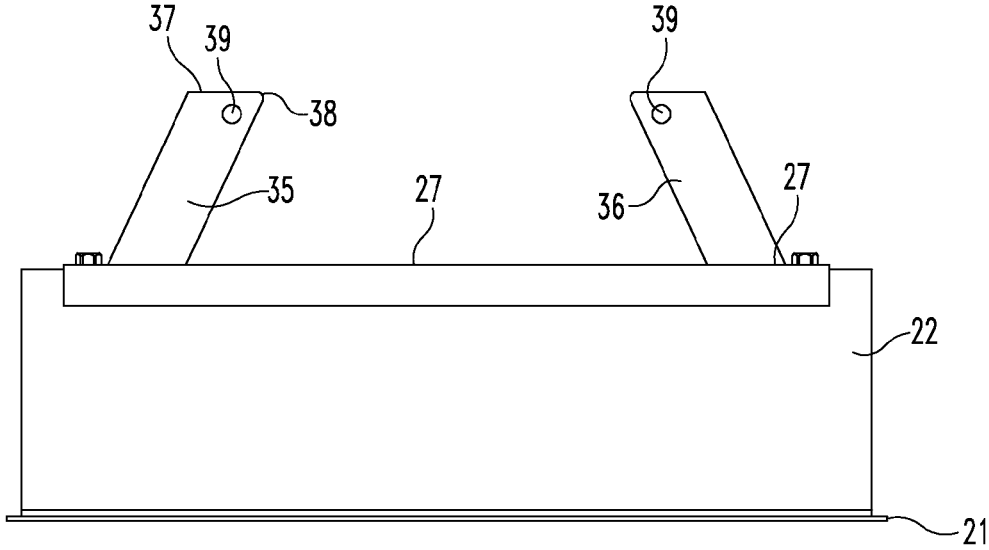
FIG. 4 is a side view of the stand without the beds pivotally mounted thereto.

A pair of upwardly extending risers or uprights 35 and 36 (FIG. 4) form a riser means fixedly mounted atop riser tube base plate 27. Risers 35 and 36 may be fastened to riser tube base plate 27 in any number of ways. For example, the bottom ends of the risers may be welded to plate 27. Further, risers 35 and 36 may be formed in a variety of configurations. In the preferred embodiment, each riser 35 and 36 is a closed channel having four sides with the bottom ends fixed to the plate 27. Each riser 35 and 36 has a top end having a flat surface and an inwardly facing radius surface. For example, riser 35 includes a flat surface 37 and a radius surface 38. Each riser includes a hole 39 through which an axle is extended pivotally mounting beds 40 and 41 (FIG. 1) there atop.

Figure 5:
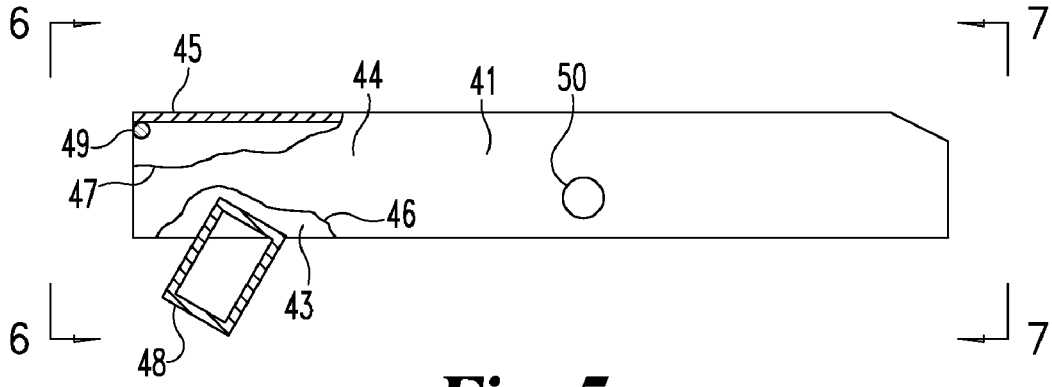
FIG. 5 is an enlarged fragmentary side view of one of the beds.
Figure 6:
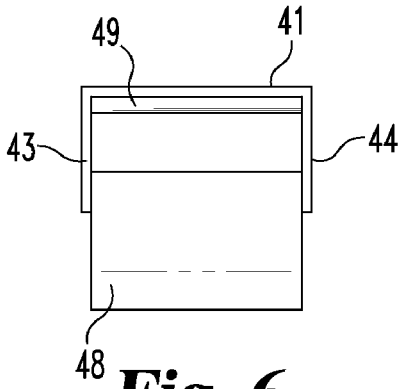
FIG. 6 is an end view looking in the direction of arrow 6-6 of FIG. 5
Figure 7:
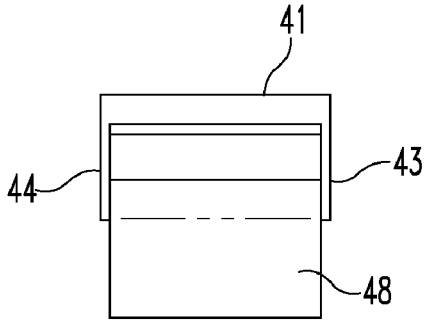
FIG. 7 is an end view looking in the direction of arrow 7-7 of FIG. 5.
Figure 8:
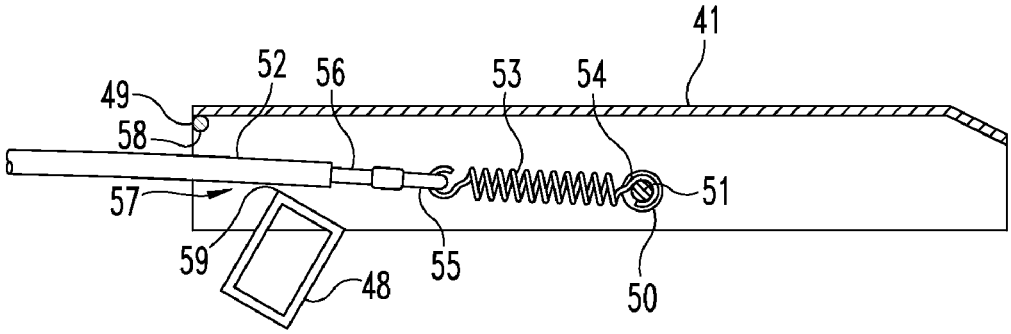
FIG. 8 is an enlarged fragmentary side view of the bed of FIG. 5 with the stretch member mounted to the bed axle.

Bed 41 (FIGS. 5-8) will now be described it being understood that an identical description applies to bed 40. Bed 41 has an inverted c-shape with a pair of side walls 43 and 44 integrally joined to a top horizontal wall 45. Wall 44 is fragmented at area 46 and 47 (FIG. 5) to illustrate the positioning of respectively stop 48 and round 49. Hole 50 (FIG. 5) extends through wails 44 and 43 to allow the bed to be mounted by an axle to riser 36.

A rectangular block or stop 48 is fixedly mounted interiorly to the sidewalls 43 and 44 of bed 41. The stop supports the bed when the bed pivots down atop riser tube base plate 27, thereby limiting the amount of downward pivotal movement of the bed.

A round or cylindrical member 49 extends immediately beneath wall 45 having its opposite ends attached to the inside surfaces of side walls 43 and 44. Member 49 provides a round surface upon which a line or a cable may slide.

Axle 51 (FIG. 8) extends through bole 39 of riser 36 and through holes 50 of bed side walls 43 and 44 thereby pivotally mounting bed 41 atop riser 36. Bed 41 is fragmented in FIG. 8 to illustrate the positioning of axle 51 along with a cable 52 and helical spring 53. Spring 53 has a proximal end 54 extending around axle 51 thereby mounting the spring to the axle. The opposite end of the spring is connected to a closed loop 55, in turn, fixedly connected to end 56 of a line or cable 52. Cable 52 extends axle 51 through a channel 57 or guide formed between the bottom facing round surface 58 of member 49 and the upper surface 59 of stop 48. Cable 52 is shown as fragmented but actually extends from axle 51 through channel 57 across the gap existing between the mutually opposed bed ends (FIG. 1) and through a similar channel formed in bed 40 between its round member 497 and stop 48. The opposite end of the cable is attached to a helical spring and extends around the axle mounting bed 40 to riser 35. In other words, the opposite ends of cable 52 are identically configured each having a helical spring extending around the adjacent axle.

Figure 9:
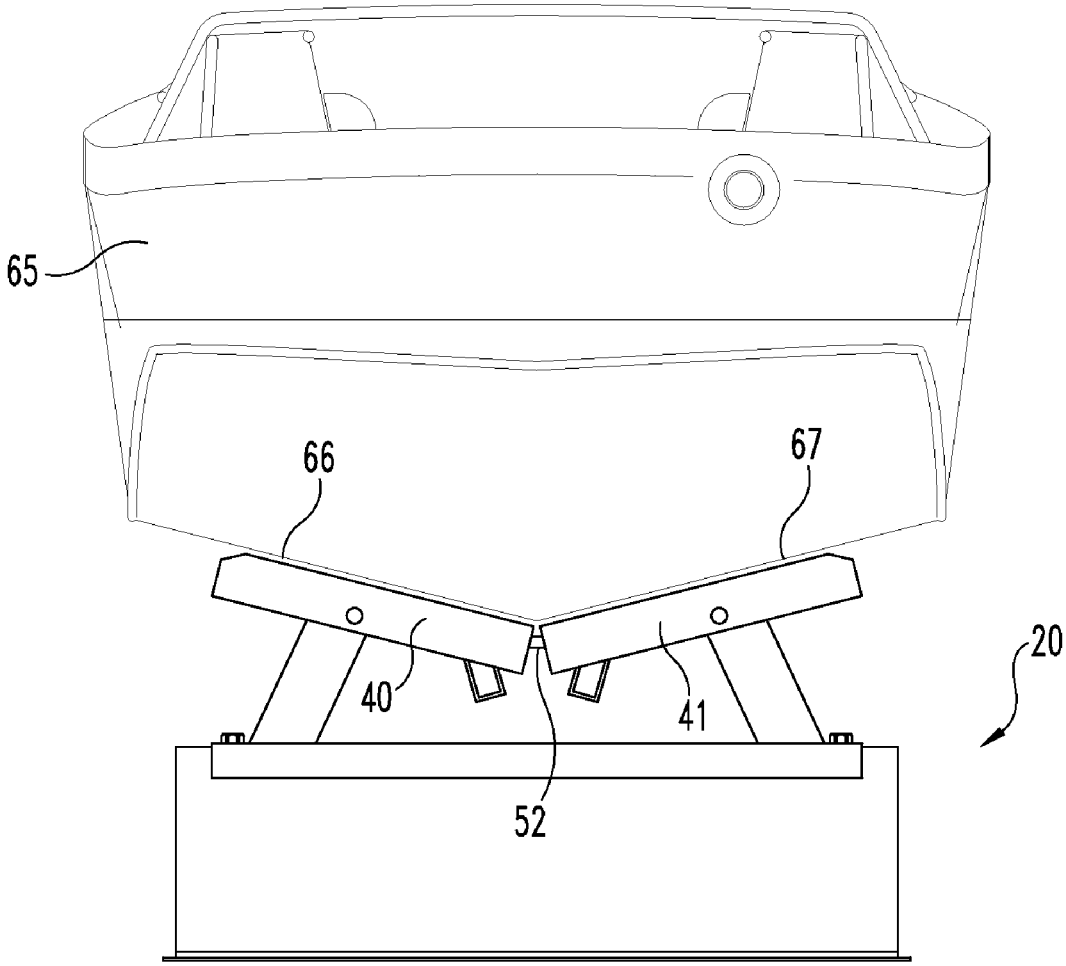
FIG. 9 is the same view as FIG. 1 only showing a boat resting upon the beds.

In operation, boat 65 (FIG. 9) is lifted and paced atop the support stand 20. The hull of boat 65 has a pair of outwardly diverging bottom surfaces 66 and 67. To eliminate the necessity for positioning the boat hull exactly in the center of the stand, surface 66 might contact the upwardly facing surface of bed 40 prior to hull surface 67 contacting the upwardly facing surface of bed 41. In such a case, surface 66 contacts bed 40 forcing bed 40 to pivot in a clockwise direction as viewed in FIG. 9. As a result, cable or line 52 will contact the downwardly facing surface 58 of round member 49 of bed 40. As bed 40 pivots downward, the helical springs attached to cable 52 extend; however, cable 52 will contact the upwardly facing end or surface 59 of stop 48 of bed 41 in the event bed 41 has also not pivoted downward. Thus, cable 52 contacting stop 48 will urge bed 41 downwardly to conformingly receive the downwardly facing hull surface 67. Thus, the beds on the stand will automatically be configured to receive the boat hull as the boat is lowered atop the stand.

As the boat is removed from the stand, downward force from the hull will be removed either simultaneously from beds 40 and 41 or first from one bed and then the remaining bed. In any event, the helical springs attached to cable 52 will contract urging the cable upwardly against the downwardly facing surfaces 58 of members 49 urging the beds to the horizontal position as depicted in FIG. 1. In the event one bed pivots upward differently than the remaining bed, then the cable will contact round member 49 of the lower bed urging the bed upward. For example, if bed 40 pivots in a counterclockwise direction as viewed in FIG. 9, cable 52 will contact the upper end 59 of stop 48 affixed to bed 40 urging the cable upward against member 49 of bed 41 thereby also urging bed 41 upwardly. In such a manner, cable 52 will automatically urge the beds to the upward position regardless of how the boat hull is removed from the stand.

Beds 40 and 41 have inner ends 60 and 61 that are at aligned and mutually facing when the beds extend horizontally in the upward position. Beds 40 and 41 also have outer ends positioned outwardly respectively of risers 35 and 36 which, in turn, pivotally mount the beds between their inner and outer ends. Each bed has a pivot axis extending through holes 39 with the pivot axis of beds 40 and 41 being parallel.

The cable or line connected to the pair of helical springs provides a stretch, that is, the cable and springs provide a stretchable device. The cable extends slidably against rounds 49 as the springs expand or stretch causing relative motion between the cable and the rounds eliminating any contact between the cable and any bed sham edge. The line contacts the first round as the downwardly extending first bed pivots to a downward position with the line being contactable against the second stop to urge the second bed to the downward position. Likewise, as the first bed pivots to the upward position, the line contacts the stop on the first bed and also is contactable against the second round mounted to the second bed to urge the second bed to the upward position. In certain cases depending upon the friction between the axle, bed, and riser, the bed may pivot downward due to its own weight since the pivot axis of each bed is located closer to the outer end than the inner end of the bed.

Many variations in the boat storage stand are contemplated and included in the present invention. For example, the boat storage stand is shown in the drawings as having channel 27 mounted atop base plate seat 22; however, the present invention includes eliminating seat 22 and mounting channel 27 directly to a support, such as, a beam. Standard fastening devices, such as, bolts, may be used to secure channel to a beam or other object.

While, the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storage stand fix holding a boat comprising:

a base:

upwardly extending riser means mounted to said base;

a first bed and a second bed mounted to said riser means being movable from an upper position to receive a boat and a downward position engaging and supporting the boat placed thereon, said first bed and said second bed each have an inner end and an outer end and are pivotally mounted to said riser means between said inner end and said outer end; and a line extending from said first bed to said second bed and operable to move said second bed to said downward position in response to said first bed moving to said downward position nestingly holding a boat thereatop, a first stop and a second stop mounted respectively to said first bed and said second bed supporting said first bed and said second bed when pivoted down atop said base, a first round and a second round on said inner end respectively of said first bed and said second bed slidingly receiving said line; and wherein said line extends between said first round and said first stop on said first bed and between said, second round and said second stop on said second bed, said line contacting said first round as said first bed pivots to said downward position and contactable against said second stop to urge said second bed to said downward position, said line contacting said first stop as said first bed pivots to said upward position and contactable against said second round to urge said second bed to said upward position, said riser means includes a first riser and a second riser mounted atop said base, said first bed and said second bed are pivotally mounted to respectively said first riser and said second riser; and further comprising:

a first spring and a second spring connected respectively to said first riser and said second riser with said line connected to and extending between said first spring and said second spring.

2. The stand of claim of 1 wherein:

said line is a cable with a first end connected to said first spring and a second end connected to said second spring.

3. A storage stand for a boat comprising:

abase:

a pair of beds pivotally mounted atop said base and aligned together when extending horizontally to receive a boat thereatop, said beds movable to a downward position; and, a stretch extending between and contactable against said pair of beds operable when one bed moves to a downward position to urge the remaining bed to a downward position to nestingly support the boat thereatop, supports extending upwardly from said base and having said beds pivotally mounted thereto about parallel pivot axis; and wherein:

said stretch includes a line with opposite ends and springs mounted to said opposite ends that are connected to said supports.

4. The storage stand of claim 3 wherein:

said beds include channels through which said line extends, said channels include surfaces, said line contactable against said surfaces when one of said beds moves to said downward position urging the other bed to also move to said downward position.

5. The storage stand of claim 4 wherein:

said base includes a flat plate and inverted U-shaped member mounted atop said plate and a plurality of reinforcing members mounted between said plate and said member.

6. A support stand for an item comprising:

a pair of uprights;

a pair of beds for supporting and storing an item with said beds being pivotally mounted to said uprights, said beds have mutually facing and aligned ends when extending horizontally in an upward position but moving apart when pivoted to a downward position; and, a line extending adjacent said beds and therebetween, said line contacting one of said beds moving said one bed downward when the remaining bed is pivoted to said downward position contacting said line, a pair of bottom stops on said ends of said beds to limit downward movement of said beds; and, a pair of slides on said ends of said beds to slidingly receive said line, said slides being spaced apart from said stops forming guides through which said line extends; and wherein:

said line is stretchable when contacted by said beds moving to said downward position.

* * * * *

UNITED STATES PATENT AND TRADEMARK OFFICE

CERTIFICATE OF CORRECTION

PATENT NO. : 7,413,379 B2
APPLICATION NO. : 11/457475
DATED : August 19, 2008
INVENTOR(S) : Tommy C. Creel and Sabrina N. Creel It is certified that error appears in the above-identified patent and that said Letters Patent is hereby corrected as shown below:

On line 1 after the ABSTRACT, please change "stands." to --stand--.

In column 1, line 45, please change "base first and:" to --base. First and--.

In column 1, line 53, please change "die" to --the--.

In column 2, line 27, please change "sane" to --same--.

In column 2, line 36, please change "unshaped" to --u-shaped--.

In column 2, line 37, please change "tried" to --turned--.

In column 2, line 40, please change "5" to --25--.

In column 3, line 13, please change "wails" to --walls--.

In column 4, line 23, please change "sham" to --sharp--.

In column 5, line 5, please remove ",".

In column 5, line 25, please change "abase:" to --a base:--.

Signed and Sealed this

First Day of September, 2009

David J. Kappos

David J. Kappos
*Director of the United States Patent and Trademark Office*